US006089655A

United States Patent [19]

Colman

[11] Patent Number: 6,089,655

[45] Date of Patent: Jul. 18, 2000

[54] SUNBATHER MISTING APPARATUS

[76] Inventor: Peter Ingalls Colman, 4301 - 32nd St., West, C-11, Bradenton, Fla. 34205

[21] Appl. No.: 09/248,662

[22] Filed: Feb. 11, 1999

Related U.S. Application Data

[60] Provisional application No. 60/074,323, Feb. 11, 1998.

[51] Int. Cl.[7] ..... A47C 7/72

[52] U.S. Cl. ..... 297/180.15; 239/289

[58] Field of Search ..... 297/180.15; 239/289, 239/506, 513, 581.1

[56] References Cited

U.S. PATENT DOCUMENTS

| | | | |
|---|---|---|---|
| 3,625,434 | 12/1971 | Kitover | 297/180.15 X |
| 4,765,542 | 8/1988 | Carlson | 297/180.15 X |
| 4,854,502 | 8/1989 | Cox | 297/180.15 X |
| 5,000,384 | 3/1991 | Arnold | 297/180.15 X |
| 5,613,731 | 3/1997 | Aspinall . | |
| 5,722,596 | 3/1998 | Dome | 297/180.15 X |
| 5,823,617 | 10/1998 | Schafer | 297/217.1 X |

*Primary Examiner*—Peter R. Brown
*Attorney, Agent, or Firm*—Dorothy S. Morse

[57] ABSTRACT

A sunbather misting apparatus comprising a lounge chair having two inverted U-shaped arms, each with a front arm support attached to the mid-section of the lounge chair seat in proximity to a seated adult's knees. The apparatus also comprises two misting nozzles each attached through the inside forward surface of one chair arm, which together provide complete mist coverage over the lounge chair seat. An on-off valve is provided between the nozzles and a pressurized water source to allow for controlled, intermittent flow of water through the nozzles. The apparatus can be directly connected to a municipal water source or a small refillable pump tank supported by the chair. The water-conserving design of the apparatus also allows multiple chair hook-ups to a single garden hose. The nozzles and connecting conduits are placed within underside recesses in the lounge chair seat and arms, and become substantially hidden from view during use. Nozzles are positioned in direct opposition to one another to cause mist projected from one nozzle to precisely impact opposing mist so that the sum total of misting fog fans out over the entire length of the lounge chair seat. During windless conditions, the mist will be confined between the sides of the chair and impact a seated adult between his or her neck and toes. Applications, while best suited for lounge chair use, are not limited thereto, and the present invention may also comprise chairs having other configurations, including folding chairs.

20 Claims, 5 Drawing Sheets

SUNBATHER MISTING APPARATUS

This patent application relates to provisional patent application 60/074,323 filed on Feb. 11, 1998 by the same inventor for the same invention disclosure. Since no new matter has been added, benefit of Feb. 11, 1998 as a priority date is herein requested.

BACKGROUND

1. Field of Invention

This invention relates to lounge chairs having systems attached thereto for use in spraying water on a sunbather, specifically to a lounge chair having a misting system that is small in dimension and compactly positioned within recesses in the underside surfaces of the lounge chair's seat and arms so as to be substantially hidden from view during use, the lounge chair comprising two chair arms each having an approximate inverted U-shape so as to comprise a front support, a rear support, and an approximately horizontal arm member connected therebetween, each front support being attached to the chair seat near to its mid-section so as to be in proximity to a seated adult sunbather's knees, and the misting system further comprising two misting nozzles each strategically housed within the inside forward portion of one of the horizontal arm members and connected to a pressurized water source through a small-bore conduit, each nozzle being positioned directly opposed to the other nozzle and configured to emit a 360° spray of fluid so as to provide an approximate 180° arc of mist in both vertical and longitudinal directions over substantially the entire length of the lounge chair seat, the opposing sprays from the two nozzles impacting one another for nearly complete mist coverage of a seated sunbather between his or her neck and toes, and wherein the positioning and configuration of the nozzles causes the atomized mist from the nozzles to be confined between the sides of the chair during windless conditions. An on-off valve connected between the nozzles and the water source allows the sunbather to regulate the duration of the mist. The water-conserving design of the present invention also allows for multiple lounge chair hook-ups to a single garden hose, as well as attachment to the lounge chair of a small refillable pressurized canister, or pump tank, that suffices as a water source adequate to provide a sunbather misting relief during an entire day in the sun. Applications, while best suited for lounge chair use, are not limited thereto, and the sunbather misting apparatus of the present invention may also comprise chairs having other configurations, including folding or otherwise collapsible chairs.

2. Description of Prior Art

Devices for sunbathers are known which attach to a lounge chair and provide a misted atmosphere over the chair. Some can be adjusted to spray all or part of a sunbather sitting or reclined in the chair. Some of the known devices have at least six or more spray heads attached to rectangular, U-shaped, or H-shaped frames which underlie the frame of the lounge chair, while others comprise frames having multiple holes therein to provide adequate water spray to cool and refresh a sunbather. However, no prior art is known to have the advantages provided by the present invention.

The prior art believed to be most closely related to the present invention is the invention disclosed in U.S. Pat. No. 5,613,731 to Aspinall (1997). Both the Aspinall invention and one embodiment of the present invention have multiple spray nozzles connected to flexible tubing, however, the Aspinall invention contemplates six nozzles to provide water spray coverage over a lounge chair, with two nozzles positioned laterally on the upper portion of the chair back on either side of the sunbather's head and oriented to spray in a forwardly direction, two nozzles positioned laterally on the lower portion of the chair seat on either side of the sunbather's feet and oriented to spray in an upwardly direction, and the remaining two nozzles each positioned on the inside of one of the chair arms and oriented to spray toward the sunbather in proximity to the sunbather's waist. The head and foot spray nozzles in the Aspinall invention are not directed toward one another and the mist created thereby would only laterally and minimally contact the mist created by the other adjacent spray nozzle. In addition, the mist from each Aspinall waist nozzle also would not fully contact the mist created by the other since the sunbather would be at least partially in the way. The water spray from the Aspinall invention would not be retained between the lounge chair arms. The Aspinall invention also contemplates a ball-valve to vary the water flow to its nozzles. In contrast, the present invention contemplates low water consumption at standard water pressures provided by municipal water systems or in the alternative at the water pressure provided by a small refillable pump tank. Also, the present invention only requires two nozzles to provide a complete atomized mist over a sunbather from neck to toe, allowing the sunbather's face and hair to remain dry during windless conditions. It is not known to have a small misting system compactly positioned within recesses in the underside portion of the arms and seat of a lounge chair, which comprises only two strategically placed misting nozzles that emit a 360° spray of fluid so as to provide a 180° arc of mist over the chair seat for nearly complete mist coverage of a seated adult between his or her neck and toes, the positioning and configuration of the nozzles also confining all mist between the sides of the chair during windless conditions.

SUMMARY OF INVENTION—OBJECTS AND ADVANTAGES

It is the primary object of this invention to provide a lounge chair with a misting system which substantially covers a seated adult with mist but during windless conditions allows the face and hair of the adult to remain dry. It is also an object of this invention to provide a lounge chair with a misting system of minimal components which is small and compactly positioned within recesses in the underside surfaces of the lounge chair seat and arms so as to be almost entirely hidden from view. A further object of this invention is to provide a lounge chair with a misting system which is water-conserving so that several misting lounge chairs can be connected to a municipal water source through a single garden hose. It is also an object of this invention for the misting system of the lounge chair to alternately use as its water source a small refillable pressurized pump tank that is supported by the lounge chair. A further object of this invention is to provide a lounge chair with a misting system that can be easily and conveniently turned on and off by the sunbather upon demand. It is also an object of this invention for the misting system of the lounge chair to be configured so as to confine the mist between the sides of the lounge chair during windless conditions.

As described herein, properly manufactured and used, the present invention would provide a lounge chair apparatus having a simple misting system comprising two nozzles capable of creating a misting fog over substantially the entire seat portion of a lounge chair so as to completely cover a seated adult sunbather between his or her neck and toes. Since the front support of each inverted U-shaped lounge chair arm would be positioned in proximity to a seated adult sunbather's knees and each nozzle would be placed within the inside forward portion of one of the horizontal arm members in direct opposition to the other nozzle, the misting fog projected from each nozzle toward the opposite lounge chair arm would impact the misting fog being projected from the other nozzle and create a tumbling effect that would cause the outer atomized fog droplets to move longitudinally toward the ends of the lounge chair seat. The conduit connecting the nozzles to a pressurized water source could either be built into recesses in the underside surface of the lounge chair seat during manufacture, particularly if the lounge chair seat and arms are made from plastic resin through molded construction, or the conduit could comprise flexible tubing attached to an independent lounge chair component. Since the misting fog projected from each nozzle of the present invention is directed toward the opposed nozzle and precisely impacts the opposing fog, unless the wind affects it, the total sum of fog is maintained between the sides of the lounge chair seat. Also, to preserve the stacking capability of non-collapsible lounge chairs, as well as allow use of the misting system of the present invention in folding chairs and facilitate packaging of the chairs for mass distribution and other purposes, the conduit connecting the nozzles is hidden within recesses in the underside surface of the lounge chair and the nozzles are each recessed within one of the horizontal arm members so as to be approximately flush with the wall surface to which it is attached. Further, since the misting system of the present invention is substantially hidden during use, a waterproof cushion or pad could be placed against the upper surface of the lounge chair seat and back for enhanced comfort of a seated sunbather and such a cushion or pad would not interfere with the operation of the misting system. In addition, the misting system is small and compactly designed for low water usage so that it can either be connected to a municipal water source or a small refillable pump tank supported by the lounge chair itself. It is not contemplated for a seated sunbather to be continuously engulfed in a mist during sunbathing, but only for the misting system to be periodically activated by the sunbather as needed to provide cooling refreshment during extended time in the sun. As a result it is contemplated that the present invention have an on-off control knob located through the side wall of the lounge chair seat to engage a valve positioned between the water source and the nozzles. Such intermittent use would allow a pump tank containing as little as three-fourths of a gallon of water to provide adequate mist to refresh a sunbather during an entire day in the sun. Also, it is contemplated for the misting system of the present invention to be configured so as to have a rapid, leak-free assembly without the use of adhesive compounds.

The description herein provides preferred embodiments of the present invention but should not be construed as limiting the scope of the sunbather misting invention. For example, variations in the configuration of the control knob connected to the on-off valve, the type of conduit used to connect the two misting nozzles to a water source, the type of on-off valve used, and the configuration of the lounge chair used as long as the front arm supports of the lounge chair are positioned in proximity to a seated adult sunbather's knees, other than those shown and described herein, may be incorporated into the present invention. Thus the scope of the present invention should be determined by the appended claims and their legal equivalents, rather than the examples given.

DETAILED DESCRIPTION OF PREFERRED EMBODIMENTS

Figure 1:
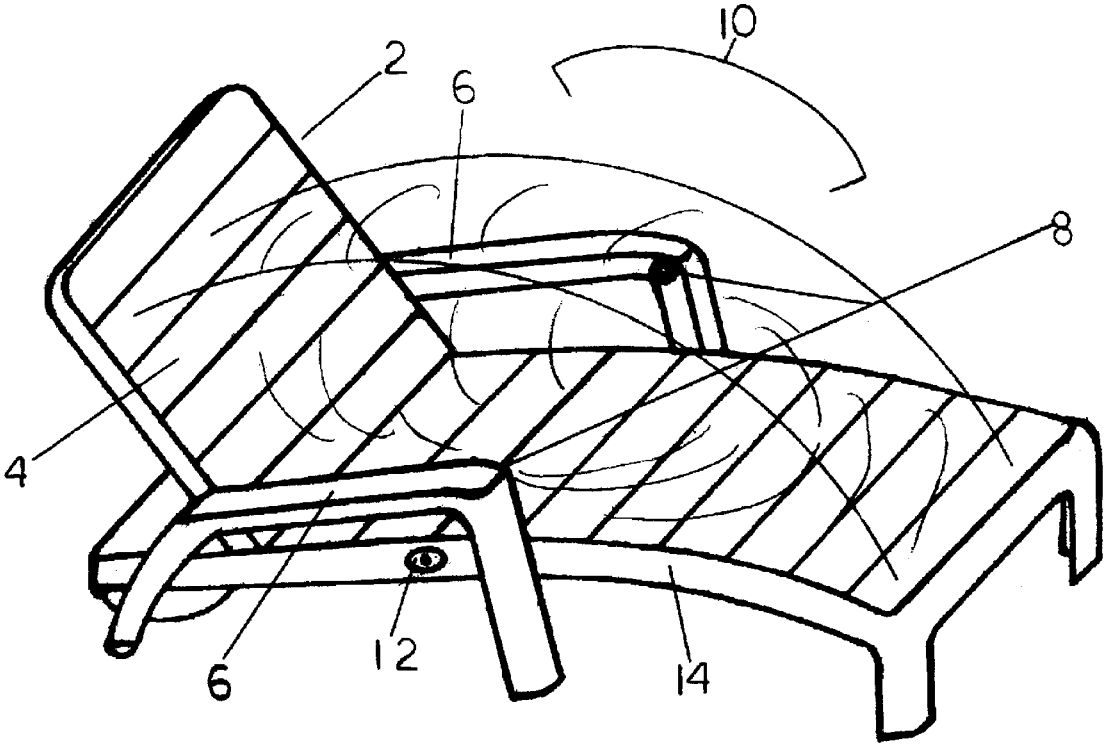
FIG. 1 is a side view of the invention having a misting nozzle secured within each arm of a lounge chair and an on-off valve connected to one side of the lounge chair.

FIG. 1 shows a preferred embodiment of a misting lounge chair invention 2 for sunbathers (not shown). Although the most preferred embodiment of the present invention comprises a lounge-type chair, use of the lounge chair configuration shown in FIG. 1 is not critical and chairs having other configurations, and those that are collapsible, are also within the contemplation of the present invention as long as they have arms of sufficient dimension to optimally position nozzles 8 for effective use. FIG. 1 shows lounge chair invention 2 having a chair back 4, a chair seat 14, and two chair arms 6 each having an inverted U-shaped configuration. The front support of each arm 6 is positioned approximately against the mid-section of chair seat 14 to be in proximity to the knees of a seated adult sunbather. FIG. 1 also shows a misting nozzle 8 positioned within the inside forward portion of the horizontal part of each arm 6 and causing a misting spray 10 from each nozzle 8 to be directed toward the opposed nozzle 8. In the preferred embodiment, nozzles 8 are cylindrical and have a diameter dimension of approximately one-half of an inch. In addition, FIG. 1 shows an external valve control 12 attached to the side of lounge chair seat 14. The positioning of external valve control 12 is not critical and can be on either side of lounge chair invention 2 as long as it is within convenient reach of a seated adult sunbather (not shown). Also, the shape of external valve control 12 is not critical, although in the preferred embodiment external valve control 12 comprises a symmetrical oval configuration having maximum X and Y dimensions of approximately one inch and two inches, respectively. At a minimum, external valve control 12 must be adaptable to an adult human hand so as to be easily rotated thereby. Chair back 4 may be movable from its original upright position into a variety of other positions, but such movement is not critical to the present invention. Also not critical are the materials from which chair back 4, chair seat 14, and chair arms 6 can be made. In addition to wood and metal, in the preferred embodiment it is contemplated for chair back 4, chair seat 14, and chair arms to be made from molded resin so as to create a waterproof lounge chair that is conveniently stackable. Any color of material is also contemplated for the present invention, as long as the combination of color and material chosen does not unnecessarily retain heat so as to be uncomfortable to the sunbather during extended use in the sun. Further, it is contemplated for the positioning of nozzles 8 to be sufficiently recessed within arms 6 so as not to prevent the stacking of one misting lounge chair invention 2 upon another, as needed to facilitate packaging of the present invention for mass distribution, as well as other purposes.

It is contemplated in the present invention to have nozzles 8 comprise the type of misting nozzle used for landscaping purposes to water shrubbery and smaller plants, as well as the type of misting nozzle used in greenhouses. It is also contemplated for misting lounge chair invention 2 to comprise a chair configuration similar to the configuration of lounge chair made by GROSSFILLEX, model numbers 44048012, 44032004, and 44004004, wherein the front support of the inverted U-shaped arms of each chair model would be positioned in proximity to the knees of a seated adult sunbather. Although not shown, it is also contemplated for misting lounge chair invention 2 to be used with a waterproof pad or cushion which can in one embodiment be made from closed cell MYLAR and display company names and/or logos. Since the components connecting nozzles 8 to a pressurized water source (not shown) are essentially hidden from view, the use of any such a waterproof pad or cushion would not interfere with the operation of the present invention.

Figure 2:
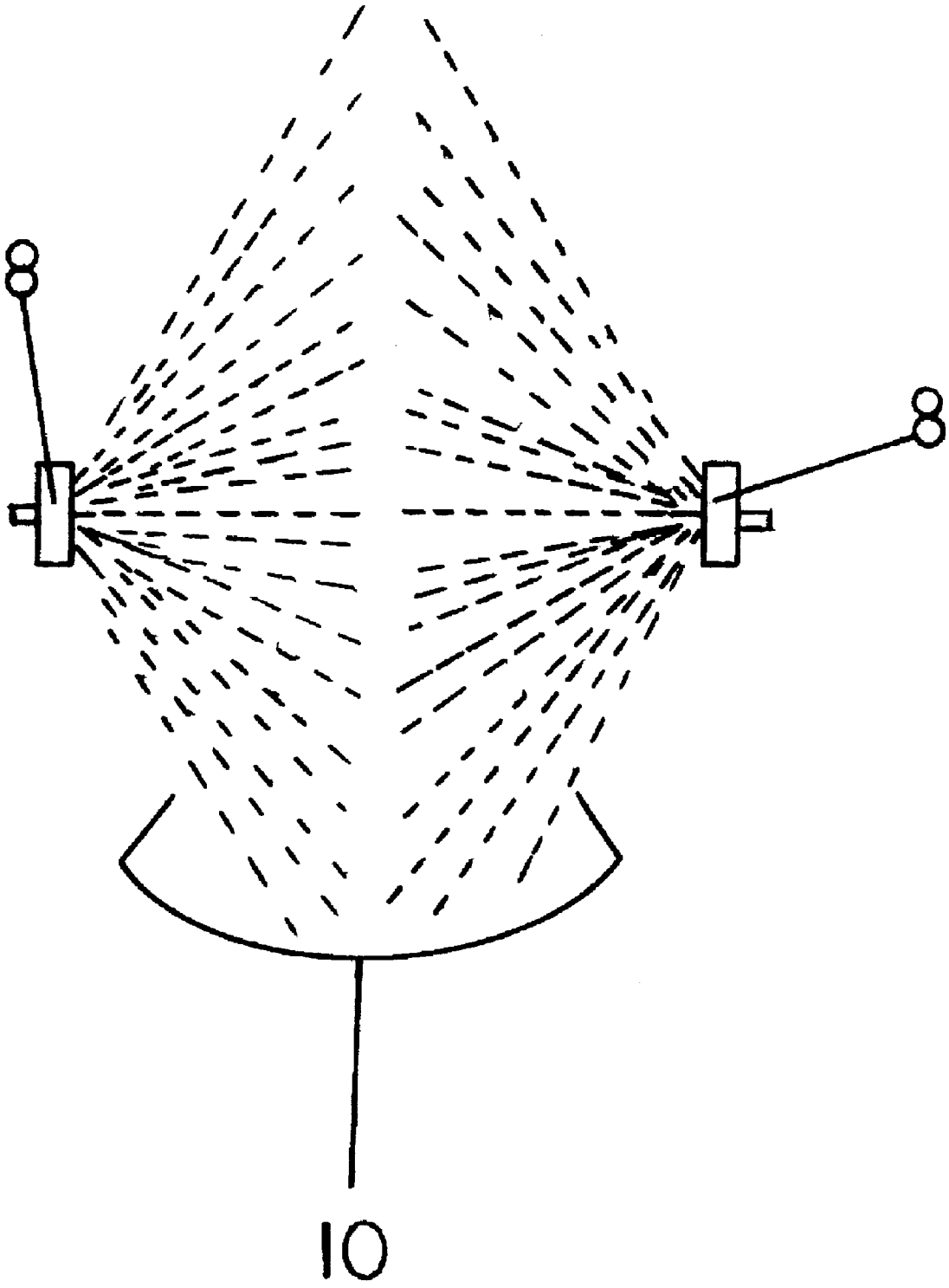
FIG. 2 is a side view of the mist spray provided by each nozzle of the invention and the manner in which each mist spray impacts the opposed mist spray.

FIG. 2 shows a side view of nozzles 8 and the misting spray 10 projected from each nozzle 8 toward the other nozzle 8. As the outer edge of one misting spray 10 collides against the outer edge of the other misting spray 10, the force of the collision causes the upwardly thrust droplets of water farthest away from each nozzle 8 to fan out longitudinally over chair seat 14 for complete coverage of a seated adult sunbather between his or her neck and toes. In the preferred embodiment it is contemplated for misting spray 10 to spread out longitudinally to a maximum length of approximately five feet.

Figure 3:
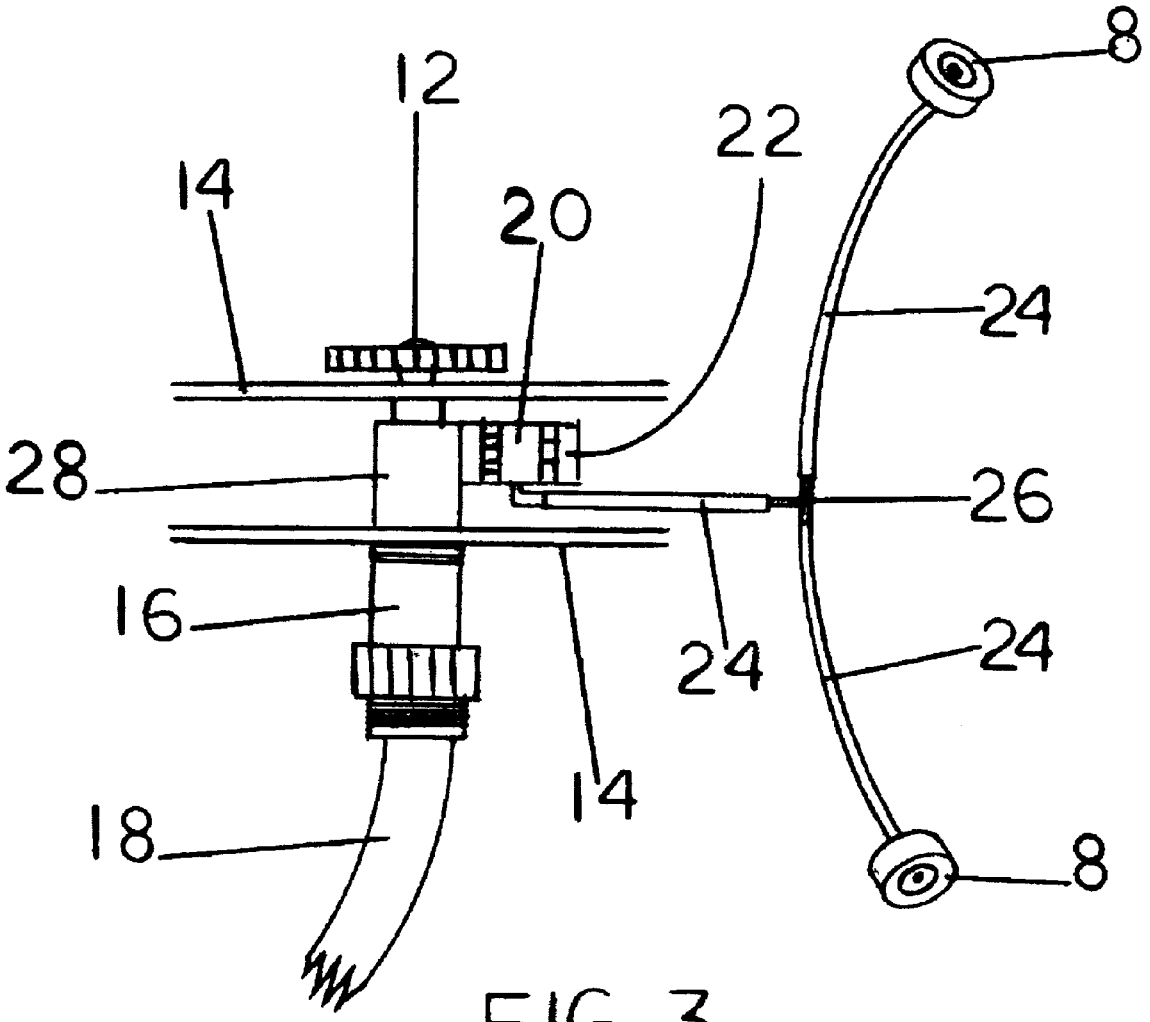
FIG. 3 is an enlarged bottom view of the misting system of one embodiment of the present invention attached to the bottom surface of a lounge chair seat.

FIG. 3 shows one preferred embodiment of the misting system of the present invention having a barrel valve 28, a reducer fitting 20, and end cap 22 positioned between the opposed walls of an underside recess in one side of chair seat 14. Connected to one end of barrel valve 28 and positioned against one exterior wall of the recess in chair seat 14 is an external valve control 12. A threaded fitting 16 is connected to the other end of barrel valve 28 for connection of a garden hose 18 thereto so that water from a remote pressurized source (not shown) can be provided to nozzles 8. The present invention only contemplates an on-off valve to control water flow to nozzles 8, and the use of a barrel-type valve, such as the barrel valve 28 shown in FIG. 3, is not critical. FIG. 3 also shows the larger end of reducer fitting 20 connected to barrel valve 28, with an end cap 22 connected to the smaller end of reducer fitting 20. All connections must be water-tight and are contemplated to be either threaded or snap-fit together without bonding agents or adhesives (not shown). FIG. 3 also shows one end of a conduit 24 connected through the side of reducer fitting 20, with the other end of conduit connected to a barbed ring-shanked T-fitting 26. Although not shown, a barbed ring-shanked fitting may also be used to connect the end of first conduit 24 through the side of reducer fitting 20. However, the connection of conduit 24 through the side of reducer fitting 20 is not critical, and although not shown, in an alternative embodiment it is contemplated for conduit 24 to be connected through the end of reducer fitting 20. FIG. 3 further shows second and third conduits 24 each connected between barbed ring-shanked T-fitting 26 and a nozzle 8. Although in FIG. 3 conduit 24 is shown to be made from flexible tubing, it is also contemplated for conduit 24 and barbed ring-shanked T-fitting 26 to be made from other materials, and in addition for the present invention to have an embodiment of lounge chair invention 2 wherein all three conduits 24 and barbed ring-shanked T-fitting 26 are made from molded plastic as a single component connected to the underside surface of chair seat 14. In the most preferred embodiment conduit 24 has an inside diameter of one-eighth of an inch, and both threaded fitting 16 and reducer fitting 20 have an inside diameter of one-half of an inch.

Figure 4:
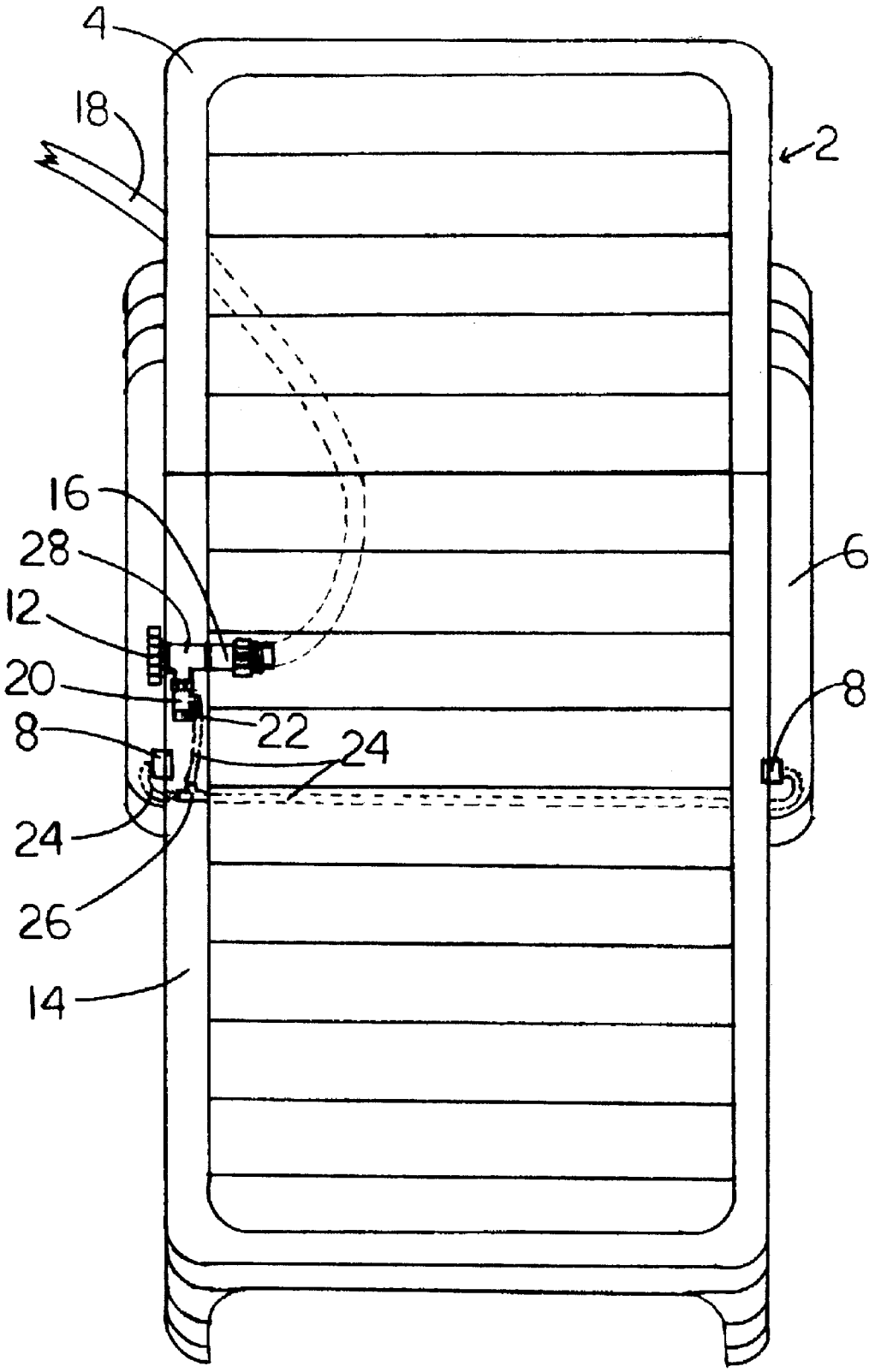
FIG. 4 is a top view of the embodiment of the present invention having its misting system connected to a garden hose.

FIG. 4 shows a preferred embodiment of misting lounge chair invention 2 having a chair back 4, chair arms 6, and a chair seat 14. The front supports of arms 6 are shown to be attached to the sides of chair seat 14 near to its mid-section. Nozzles 8 are each connected through the forward inside wall of the horizontal part of one arm 6. FIG. 4 also shows one conduit 24 connecting each nozzle 8 to barbed ring-shanked T-fitting 26 and a third conduit 24 connected between barbed ring-shanked T-fitting 26 and the smaller end of reducer fitting 20. FIG. 4 further shows the larger end of reducer fitting 20 connected to barrel valve 28 and external valve control 12 connected to barrel valve 28 through the wall of an underside recess in one side of chair seat 14. Although FIG. 4 shows external valve control 12 positioned beneath one arm 6 near to its front support, the exact positioning of external valve control 12 is not critical to the present invention as long as external valve control 12 is conveniently positioned for rapid easy use by a sunbather. FIG. 4 shows the other end of barrel valve 28 connected to threaded fitting 16 through the wall of an underside recess in chair seat 14, with a garden hose 18 connected to the distal end of threaded fitting 16.

Figure 5:
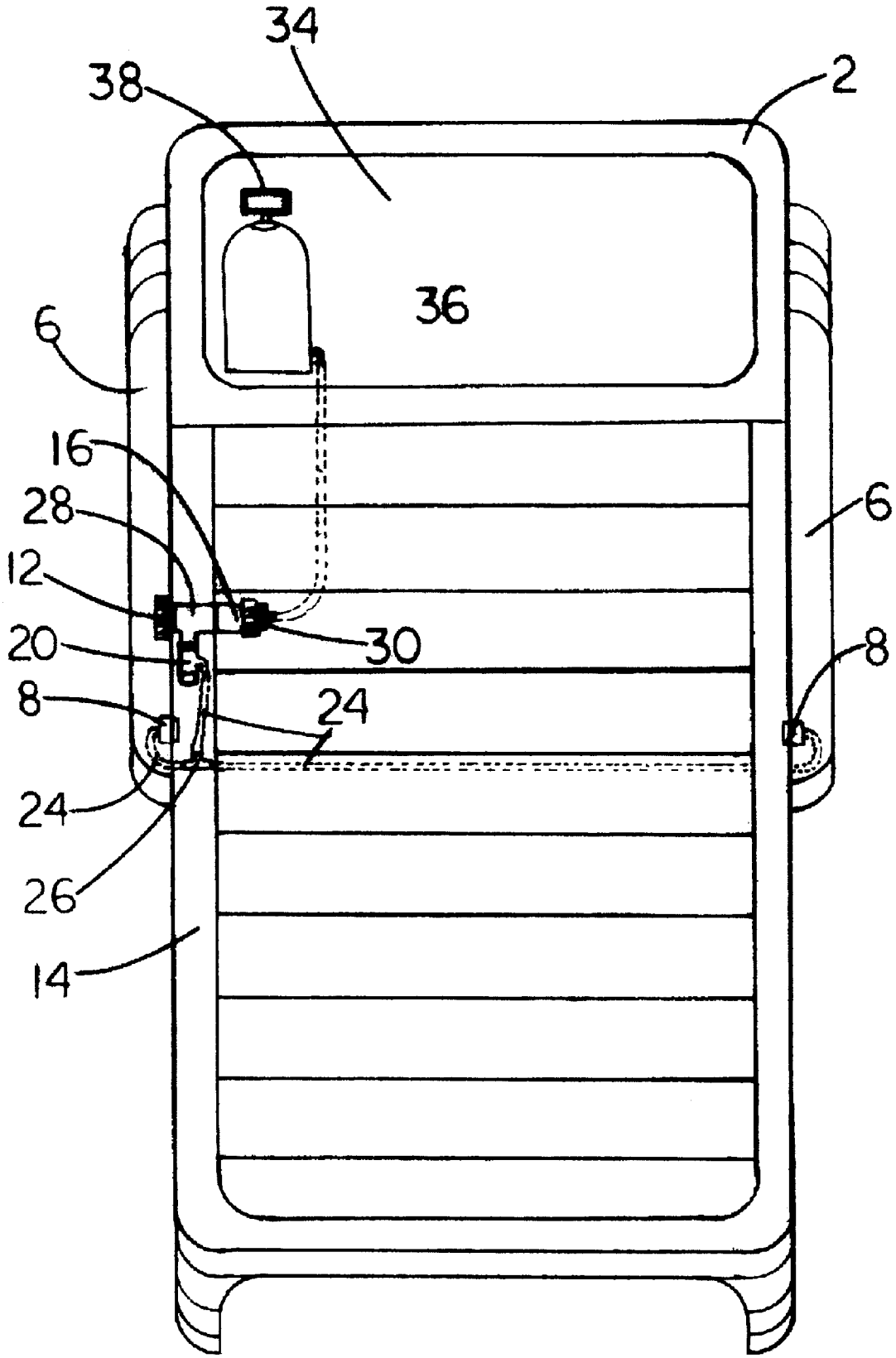
FIG. 5 is a top view of the embodiment of the present invention having its misting system connected to a pump tank supported by the lounge chair, the chair back being removed for clarity of illustration.

FIG. 5 shows a top view of an alternative embodiment of misting lounge chair invention 2 wherein water provided for nozzles 8 is housed in a small pump tank 36 that is supported by chair seat 14 within a cavity 34 in the upper surface of chair seat 14 that is positioned behind chair back 4. FIGS. 1 and 4 may be referenced for the positioning of chair back 4 against chair seat 14 since chair back 4 is removed from FIG. 5 for clarity of illustration. Although not shown, pump tank 36 would have an opening somewhere through its housing to allow for periodic refilling with water (not shown). Also, although not critical it is contemplated for the preferred embodiment of pump tank 36 to have a minimum liquid capacity of approximately three-fourths of a gallon to allow use of misting lounge chair invention 2 by a sunbather for an entire day in the sun. In most embodiments, and as shown in FIG. 5, pump tank 36 only partially occupies the interior space in cavity 34. As needed prior to use, handle 38 would be manipulated by the sunbather to cause pressurization within pump tank 36. Consequently, as the sunbather rotates external valve control 12, the built-up pressurization within pump tank 36 would cause water to be forced from pump tank 36 and through nozzles 8 to produce a misted fog over substantially the entire length of chair seat 14. In FIG. 5 the front supports of arms 6 are each shown to attach to one side of chair seat 14 near to its mid-section. Nozzles 8 are each connected through the forward inside wall of one arm 6 in a position directly opposed to one another. FIG. 5 also shows one conduit 24 connecting each nozzle 8 to barbed ring-shanked T-fitting 26 and a third conduit 24 connected between barbed ring-shanked T-fitting 26 and the smaller end of reducer fitting 20. FIG. 5 further shows the larger end of reducer fitting 20 connected to barrel valve 28 and external valve control 12 connected to barrel valve 28 through the wall in an underside recess in one side of chair seat 14. The other end of barrel valve 28 is connected to threaded fitting 16 through the opposed wall of the underside recess in chair seat 14, with a hose 32 connected between the distal end of threaded fitting 16 and pump tank 36. Similar to the construction of conduit 24, it is contemplated for hose 32 to be made from flexible tubing, or made from plastic resin as a built-in component attached to the underside surface of chair seat 14 through molded construction. Although not shown and not critical, it is also contemplated for cavity 34 to have a cover to keep pump tank 36 out of the direct sun during use.

To use preferred embodiments of misting lounge chair invention 2, a sunbather (not shown) would connect garden hose 18 to a remote pressurized water supply (not shown) or add water to pump tank 36 and manipulate handle 38 to cause pressurization within pump tank 36. After becoming seated upon chair seat 14 the sunbather would rotate external valve control 12 ninety degrees to open barrel valve 28. On a hot day, the water within garden hose 18 and hose 32 would become warm and the opening of barrel valve 28 would cause an initial mist of warm water to be propelled over the sunbather. As a result, the warm sunbather would not be subjected to a shocking mist of cold water and instead could become accustomed to the gradual decrease in water temperature as cooler water from the remote pressurized water source reaches nozzles 8. When the sunbather is sufficiently saturated with water and refreshed, the sunbather could again rotate external valve control 12 ninety degrees to close barrel valve 28 and stop misting spray 10. Periodically as needed, the sunbather could repeatedly open and close barrel valve 28 to provide intermittent periods of misting spray 10 over chair seat 14 upon demand. A waterproof cushion or pad (not shown) could be placed upon chair seat 14 to provide additional comfort to the sunbather. Since the components connecting nozzles 8 to the pressurized water source (not shown) are substantially hidden within recesses under chair seat 14 and arms 6, use of the cushion or pad would not interfere with the operation of lounge chair invention 2. It is equally contemplated for the components connecting nozzles 8 to be built into the chair back 4, chair seat 14, and chair arms 6 of a lounge chair during manufacture, or to be retrofitted into an existing lounge chair. To allow stacking of one misting lounge chair invention 2 upon another, it is contemplated for each nozzle 8 to be positioned within one arm 6 with its spraying aperture (not shown) nearly flush against the wall surface of the underside recess in arm 6. Also, it is contemplated for conduit 24 to be closely held against the bottom surface of chair seat 14. Further, since misting lounge chair invention 2 is designed for low water consumption during use, multiple misting lounge chair inventions 2 could each be attached in series to a remote pressurized water supply through use of a single garden hose 18. In addition, the general design of chair seat 14 is not critical and it is contemplated for different embodiments of chair seat 14 to have a variety of features, including but not limited to a covered storage compartment, a built-in ice chest, and an umbrella holder.

What is claimed is:

1. A sunbather misting apparatus for providing nearly complete misting coverage between the neck and toes of a seated sunbather sitting thereon while allowing the face and hair of the sunbather to remain dry in windless conditions, said apparatus comprising a chair made from water resistant materials, said chair having a front, a back, a seat, and two inverted U-shaped arms, each of said arms having a front support and an approximately horizontal arm member, said front support adapted to be positioned in proximity to the knees of an average adult sunbather sitting in said seat; and a small, simple, and compactly dimensioned misting system connected to said chair so as to be substantially hidden from view, said misting system comprising two misting nozzles each capable of emitting a 360° spray of misted water so as to provide an approximate 180° arc of mist in both vertical and longitudinal directions, each of said misting nozzles being connected through said horizontal arm member of one of said arms in a position near to said front support so that mist emitted from each of said misting nozzles contacts opposing mist above the legs of a sunbather seated in said chair, each of said misting nozzles also being placed in a position directly opposed to the other of said misting nozzles and oriented so as to aim misting fog directly toward the other of said misting nozzles, said misting system also comprising a fluid transport means adapted for connection between each of said misting nozzles and a pressurized supply of water, said fluid transport means comprising a T-shaped channel adapted for conveying pressurized fluid and two small-bore conduits each also adapted for conveying pressurized fluid, each of said conduits being in fluid communication with and positioned between a different one of said nozzles and said T-shaped channel, said fluid transport means also comprising a barrel valve and one additional small-bore conduit in fluid communication with and positioned between said barrel valve and said T-shaped channel, said fluid transport means further comprising reducer means between said barrel valve and said additional small-bore conduit, said fluid transport means also adapted to provide water of uniform pressure to both of said misting nozzles whereby atomized mist projected from each of said nozzles impacts directly against opposed mist to cause a tumbling effect so that outer atomized droplets in the misting fog move longitudinally toward said front and said back of said chair and remain confined between said arms of said chair during windless conditions.

2. The apparatus of claim 1 wherein said chair is selected from a group consisting of non-collapsible lounge chairs and folding lounge chairs.

3. The apparatus of claim 1 wherein said fluid transport means comprises, an on-off valve connected between said misting nozzles and the pressurized water supply, said valve being attached to said chair in a position easily accessible by a seated adult sunbather, said valve also having a control means adapted for easy hand manipulation by the seated adult sunbather between an open position allowing water flow to said misting nozzles and a closed position wherein water flow to said misting nozzles is stopped.

4. The apparatus of claim 3 further comprising a refillable pump tank adapted for containing a pressurized supply of water and connection means adapted to provide fluid communication between said pump tank and said fluid transport means.

5. The apparatus of claim 4 wherein said pump tank has a minimum fluid capacity of approximately three-fourths of a gallon.

6. The apparatus of claim 4 wherein said chair is configured to support said pump tank.

7. The apparatus of claim 1 wherein said chair has a stackable design and each of said misting nozzles is positioned flush within one said arms and said fluid transport means is positioned and secured closely to said chair so as to allow compact storage of said apparatus with minimal risk of damage to said spray nozzles and said fluid transport means during storage, preparation for storage, and preparation after storage for subsequent use.

8. The apparatus of claim 1 wherein said chair is manufactured as a one-piece unit through molded construction and at least a portion of said fluid communication means is incorporated directly into said chair as part of said molded construction.

9. The apparatus of claim 1 wherein said fluid transport system comprises an external valve control and a threaded fitting, wherein said reducer means comprises a reducer fitting, wherein said two small-bore conduits and said additional small-bore conduit are flexible, and wherein said T-shaped channel comprises a barbed ring-shanked T-fitting, with said external valve control being connected to said barrel valve and adapted for manipulation of said barrel valve between an open position wherein water is permitted to flow to said misting nozzles and a closed position wherein water flow to said misting nozzles is halted, said threaded fitting also being connected to said barrel valve and adapted for providing fluid communication between said barrel valve and a pressurized supply of water, and said reducer fitting also being connected between said barrel valve and one end of said additional small-bore conduit.

10. The apparatus of claim 1 wherein said misting nozzles have an approximately cylindrical configuration and have a maximum diameter of approximately one-half inch.

11. A low water consumption sunbather misting apparatus for providing nearly complete misting coverage between the neck and toes of a seated sunbather sitting thereon while allowing the face and hair of the sunbather to remain dry in windless conditions, said apparatus comprising a chair made from water resistant materials, said chair having a front, a back, a seat, and two inverted U-shaped arms, each of said arms having a front support and an approximately horizontal arm member, said front support adapted to be positioned in proximity to the knees of an average adult sunbather sitting in said seat; and a compactly dimensioned misting system connected to said chair so as to be substantially hidden from view, said misting system comprising two misting nozzles each capable of emitting a 360° spray of fluid so as to provide an approximate 180° arc of mist in both vertical and longitudinal directions, each of said misting nozzles being connected through said horizontal arm member of one of said arms in a position near to said front support so that mist emitted from each of said misting nozzles contacts opposing mist above the legs of a sunbather seated in said chair, each of said misting nozzles also being placed in a position directly opposed to the other of said misting nozzles and oriented so as to aim misting fog directly toward the other of said misting nozzles, said misting system also comprising a fluid transport system adapted for connection between each of said misting nozzles and a pressurized supply of water, said fluid transport system also providing water of uniform pressure to both of said misting nozzles whereby atomized mist projected from each of said nozzles impacts directly against opposed mist to cause a tumbling effect so that outer atomized droplets in the mist move longitudinally toward said front and said back of said chair and remain confined between said arms of said chair during windless conditions, and wherein said fluid transport system comprises a quantity of flexible conduit suitable for the transport of water, a barrel valve, an external valve control, a reducer fitting, a threaded fitting, and a barbed ring-shanked T-fitting, with said external valve control being connected to said barrel valve and adapted for manipulation of said barrel valve between an open position wherein water is permitted to flow to said misting nozzles and a closed position wherein water flow to said misting nozzles is halted, said threaded fitting also being connected to said barrel valve and adapted for providing fluid communication between said barrel valve and a pressurized supply of water, said reducer fitting also being connected between said barrel valve and one end of a first portion of said conduit, said barbed ring-shanked T-fitting connected between said first portion of said conduit and a second and a third portion of said conduit, and said second and third portions of said conduit each being connected to a different one of said misting nozzles.

12. The apparatus of claim 11 wherein said chair is selected from a group consisting of non-collapsible lounge chairs and folding lounge chairs.

13. The apparatus of claim 11 further comprising a refillable pump tank adapted for containing a pressurized supply of water and connection means adapted to provide fluid communication between said pump tank and said fluid transport means.

14. The apparatus of claim 13 wherein said pump tank has a minimum fluid capacity of approximately three-fourths of a gallon.

15. The apparatus of claim 13 wherein said chair is configured to support said pump tank.

16. The apparatus of claim 11 wherein each of said misting nozzles is positioned flush within one said arms and said fluid transport means is positioned and secured closely to said chair so as to allow compact storage of said apparatus with minimal risk of damage to said spray nozzles and said fluid transport means during storage, preparation for storage, and preparation after storage for a next use.

17. The apparatus of claim 11 wherein said chair is manufactured as a one-piece unit through molded construction and at least a portion of said fluid communication means is incorporated directly into said chair as part of said molded construction.

18. A method for providing a mist to completely cover a sunbather from neck to toes while allowing the face and hair of the sunbather to remain dry in windless conditions, said method comprising the steps of providing a chair having a front, a back, and two inverted U-shaped arms; two misting nozzles each capable of emitting a 360° spray of fluid so as to provide an approximate 180° arc of mist in both vertical and longitudinal directions; fluid transport means; a barrel valve with an easily manipulated external valve control; and a supply of pressurized water;

connecting each of said misting nozzles to one of said inverted U-shaped arms in positions directly opposed to one another so that mist emitted from each of said misting nozzles contacts opposing mist above the legs of a sunbather seated in said chair and further so that mist projecting from each of said misting nozzles is aimed to impact directly against opposed mist to cause a tumbling effect in which outer atomized droplets in the mist move longitudinally toward said front and back of said chair and remain confined between said arms of said chair during windless conditions, and also so that said misting nozzles are positioned in proximity to the knees of a seated sunbather sitting on said chair;

using said fluid transport means to connect each of said nozzles to said pressurized water supply so that water is provided to both of said nozzles at the same pressure; and connecting said barrel valve to said fluid transport means so as to provide a means for a sunbather to control the duration of time mist is projected from said misting nozzles.

19. The method of claim 18 wherein said step of providing said fluid transport means comprises the providing of a quantity of flexible conduit suitable for the transport of water, a reducer fitting, a threaded fitting, and a barbed ring-shanked T-fitting, and wherein said method further comprises the steps of connecting said threaded fitting between said barrel valve and said pressurized water supply; further connecting said reducer fitting between said barrel valve and one end of a first portion of said conduit, connecting said barbed ring-shanked T-fitting between said first portion of said conduit and a second and a third portion of said conduit; and connecting said second and third portions of said conduit each to a different one of said misting nozzles.

20. The method of claim 19 wherein said step of providing a pressurized supply of water comprises the step of providing a supply of water in a refillable pump tank.

* * * * *